US006540192B2

(12) United States Patent
Ouellet

(10) Patent No.: US 6,540,192 B2
(45) Date of Patent: Apr. 1, 2003

(54) INTEGRATED EASEL, HORIZONTAL ARTWORK SURFACE AND ART SUPPLY CASE

(75) Inventor: Sarah Eve Ouellet, Montreal (CA)

(73) Assignee: Maison Joseph Battat Ltee, Montreal (CA)

( * ) Notice: Subject to any disclaimer, the term of this patent is extended or adjusted under 35 U.S.C. 154(b) by 0 days.

(21) Appl. No.: 09/922,012

(22) Filed: Aug. 3, 2001

(65) Prior Publication Data

US 2003/0025061 A1 Feb. 6, 2003

(51) Int. Cl.[7] ..... A47B 97/08

(52) U.S. Cl. ..... 248/461; 248/441.1; 248/460; 248/447

(58) Field of Search ..... 248/441.1, 444, 248/447, 460, 461; 190/108, 110

(56) References Cited

U.S. PATENT DOCUMENTS

| | | | | | |
|---|---|---|---|---|---|
| 213,166 | A | * | 3/1879 | Brownell | |
| 2,586,524 | A | * | 2/1952 | Dussardier | 45/129 |
| 3,082,049 | A | * | 3/1963 | Lifton | 312/200 |
| 3,136,082 | A | * | 6/1964 | Sloves | 40/102 |
| 3,168,363 | A | * | 2/1965 | Monsour | 312/231 |
| 3,311,202 | A | * | 3/1967 | Schell et al. | 190/16 |
| 3,378,322 | A | * | 4/1968 | Johnson | 312/231 |
| 4,093,326 | A | * | 6/1978 | Ford | 312/231 |
| 5,501,603 | A | * | 3/1996 | Mueller et al. | 434/419 |
| D369,677 | S | * | 5/1996 | Bussmann et al. | D3/282 |
| 6,045,108 | A | * | 4/2000 | Cziraky | 248/454 |
| 6,164,976 | A | * | 12/2000 | Wilson | 434/414 |

* cited by examiner

*Primary Examiner*—Anita King
*Assistant Examiner*—Steven Marsh
(74) *Attorney, Agent, or Firm*—Levisohn, Lerner, Berger & Langsam LLP

(57) ABSTRACT

An integrated easel, horizontal artwork support surface and art supply carrying case comprises a lower housing forming an art supply holding container and an upper housing providing a downwardly extending cavity. The upper housing in hingedly connected to the lower housing about their respective front walls. A horizontal, second artwork supporting surface hingedly connects to the lower housing about their respective rear walls. The upper housing has a flat surface for artwork and an easel-like stand hingedly attached to the rear of the flat surface which cooperates with the horizontal, second artwork supporting surface for holding the flat surface at an angle with respect to the lower housing. The device is compact, versatile, easy to carry and allows a child to use various art media.

19 Claims, 4 Drawing Sheets

INTEGRATED EASEL, HORIZONTAL ARTWORK SURFACE AND ART SUPPLY CASE

FIELD OF THE INVENTION

The present invention relates generally to an art-supporting apparatus intended for use by children. More particularly, the present invention relates to an easily portable easel and related art-support and work surfaces, integrated into a carrying case for art supplies. The device has two artwork surfaces, a) an inclined surface for drawing, painting, sketching etc. on paper secured thereto or by use of markers on the whiteboard surface of the inclined surface and b) a separate, horizontal work surface. The horizontal, second artwork supporting surface may also be used for a child's artwork, e.g., fingerpaints, pencils or charcoal on paper secured or upon the second surface or chalk, crayons or other writing instruments can be used directly on the writing side of the horizontal surface. The device is thus quite versatile in that it allows a child to use a variety of artistic media. When the art activity is finished, the device easily folds into an art supply carrying case which is easily transported by a simple handle.

Importantly, the portable easel with multiple work surfaces and integrated carrying case for art supplies covers a minimum of tabletop surface area. This is especially important when one appreciates that children using the device may be traveling in a car, on a boat, train, bus or airplane. A child's available lap or the sometimes present fold-down tables in those listed environments are quite limited in surface area such that a compact yet versatile device is welcome by parents and children. As will be more fully explained hereinafter, the device is desirably molded from lightweight, colorful plastic components.

BACKGROUND OF THE INVENTION

Portable art supply cases with integrated easels, even those which are made of lightweight plastic for children, are commercially available. They provide an inclined plane for supporting artwork. The easel support may be folded or stored into the integrated carrying case for artistic supplies. However, one such device, available from Binney & Smith under the CRAYOLA trademark and model name: Portable Tabletop Easel, merely provides a single work surface, the inclined easel, and has a sliding drawer for the art supplies. The sliding drawer is disadvantageous because it necessitates more surface area than a simple container for the art supplies where the child can access the supplies by merely reaching therein. In addition, the prior art does not teach nor suggest a portable easel (art support surface) and integrated art supply carrying case having both inclined and horizontal work surfaces such that the child can use a variety of media for artwork, with two or more pieces of artwork being available for visual display thereon. The present invention, as will be explained, has multiple work surfaces, one inclined and one horizontal for allowing the child to use different media. The child may display the same, easily and conveniently. Also, the present invention provides the multiple art work surfaces within the context of an integrated bin-type (in contrast to a sliding drawer) art supply container. This reduces the surface area needed for access to the art supplies.

Also, by eliminating the sliding drawer of the Binney & Smith device, a separate plastic part is eliminated with its incident cost. The component parts of the present invention are all connected together such that one cannot become disengaged from the others and fall or become lost whereas the sliding drawer of the Binney & Smith device is a separate part which can be easily dropped by a child or separated from the device. The integration of all pieces has clear advantages.

There are many portable easels that are used by children and which allow children to carry art supplies within the carrying case attached to such easels. However, the prior art easels known to applicant have disadvantages, such as mentioned above. Generally, the prior art does not efficiently use available tabletop space and/or does not provide, as the present invention, both an inclined and horizontal artwork surface, e.g., an inclined easel also supplying a magnetic board or whiteboard surface and a horizontal surface which supports paper and is useful for writing or drawing thereon. The present invention provides many of the features just described in an efficient, economical and simple manner.

SUMMARY OF THE INVENTION

The invention relates to a device intended to provide an artistic work surface to a child which is integrated with a carrying case for associated art supplies. The portable easel portion, i.e., the inclined artwork surface may be quickly and easily folded into and erected from a carrying case for art supplies. The easel aspect of the device is an inclined surface for supporting paper for artwork. In addition, the easel is a magnetic whiteboard, allowing the child to draw directly thereon with suitable erasable whiteboard markers or to use magnetic letters/number/characters. Thus, the easel is quite versatile.

The carrying case may also be provided with a separate, substantially horizontal artwork surface for displaying or creating artwork thereon. This surface, too, can hold paper for drawing, painting, sketching, etc. In addition, the horizontal work surface can have a blackboard surface for chalk-based artwork. Here, too, a versatile device is provided with added play value for a child. The device is made such that both the slanted easel and the horizontal artwork surface are quickly accessible. Thus, the child can work on two art projects, -one after the other. Also, by having two artwork surfaces quickly accessible, two children can use a single device, each drawing or creating his or her own art project. This, too, is quite efficient and advantageous.

Accordingly, it is an object of the invention to provide a portable easel, i.e., an inclined or slanted work surface support for children's artwork, integrated into an art supply carrying case. The easel and a horizontal, second work surface are sufficiently lightweight to allow them to be folded into and erected from a portable carrying case and, yet, provide support for art projects.

It is a further object of the invention to provide a portable easel that is integrated into a carrying case and which may be used to carry children's art supplies.

It is a further object of an embodiment of the invention to provide an easel for supporting paper for an art project which easel also allows a child to use erasable markers on the whiteboard portion of the easel. Also, as mentioned, it is an object of the present invention for the whiteboard of the easel to be magnetic so that magnetic pieces may be used by the child, too.

It is also an object of the present invention to provide the device with both an inclined artwork surface, the easel and magnetic whiteboard, along with a separate horizontal surface for creating or displaying artwork. As mentioned, the separate horizontal artwork surface can support paper for art projects and, in addition, can be a board for use with art or writing instruments.

It is an object of the present invention to provide two separate artwork support surfaces, one inclined and one horizontal, both easily accessible by a child so that a child can use one of the support surfaces of the device without impacting on the other artwork surface. It is also an object of the present invention to provide two artwork surfaces, at least one of which is horizontally supported during use, the other preferably selectively inclined, which can be alternatively used by a child.

It is a further object of the present invention to provide two artwork supporting work surfaces of different types, i.e., one paper supporting, the other either a whiteboard, a blackboard, a magnetic board and/or a paper supporting surface. Preferably, each of the supporting artwork surfaces has multiple characteristics. For example, the inclined surface can hold paper and be a magnetic whiteboard. The other artwork supporting surface can be used horizontally and can be a paper holding surface and/or a blackboard or other art surface.

It is a further object of the present invention to provide an integrated carrying case and two artwork supporting surfaces which provide visual and work support surfaces for multiple art mediums. The device is intended to be used by a child.

Other objects advantages and features of this invention will become more apparent hereinafter.

BRIEF DESCRIPTION OF THE DRAWINGS

The preferred embodiment of the present invention will now be described with reference to the accompanying drawings in which.

DETAILED DESCRIPTION OF THE PREFERRED EMBODIMENT AND THE DRAWINGS

Figure 1:
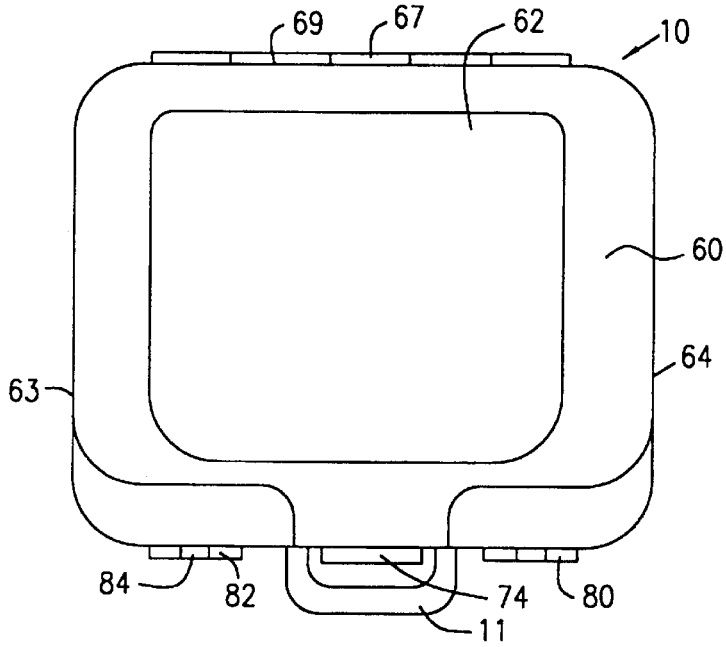
FIG. 1 is a top view of the preferred embodiment of the present invention, with the carrying handle extended.

Turning initially to FIG. 1, there is illustrated a top plan view of the preferred embodiment of the present invention, an integrated easel, horizontal artwork support surface and art supply case 10 in its fully closed and intended for transporting position. For ease of illustration, the hand-gripping handle 11 (for facilitating carrying of the device 10) is shown in FIG. 1 as projected away from the case. FIGS. 2, 3, 4, 5A and 7 show the handle 11 in its normal position, i.e., substantially flush with the front and outside edge 42 of the lower housing. The components of the device are preferably made of colorful, inexpensive and lightweight plastic (except for the hinges which may contain some metal or hinge pins and the magnetic aspects of the artwork surfaces).

The integrated easel, horizontal artwork surface and art supply case 10 basically consists of four principal components (and a handle): a lower housing 14, providing the storage area for art supplies; an upper housing 12 providing the whiteboard surface and the inclined easel surface having clips for paper for artwork; a horizontal, second artwork supporting surface 60, having a surface for drawing thereon and also providing support for paper for artwork; and an A-shaped support bracket 24, hingedly attached to the rear 32 of the flat surface 30 of the upper housing 12 for supporting the upper housing 12 and easel surface on top of the horizontal, second artwork supporting surface 60.

The upper housing 12 and lower housing 14 are hinged together so that the upper housing can rotate into an inclined orientation for use by a child as an easel surface (see FIGS. 4, 5A, 6 and 7). The upper housing 12 can also rotate to close over the lower housing (with the horizontal, second artwork supporting surface 60 first rotated out of the way). Then, with the upper housing on top of the lower housing, the horizontal, second artwork supporting surface 60 covers the upper housing (see FIGS. 1–3). The hinge mechanism between the upper housing and lower housing allows the upper housing 12 to move off of the lower housing 14 (after the horizontal, second artwork supporting surface 60 is first lifted off of the upper housing 12), to gain access to the contents and area of the lower housing 14.

Figure 2:
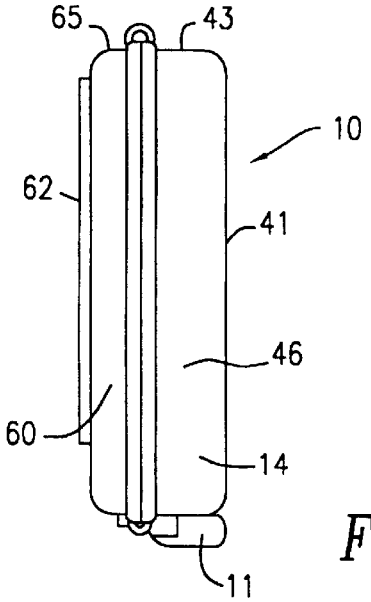
FIG. 2 is a right side view of the preferred embodiment of the present invention (the left side plan view being a substantial mirror image thereof)
Figure 3:
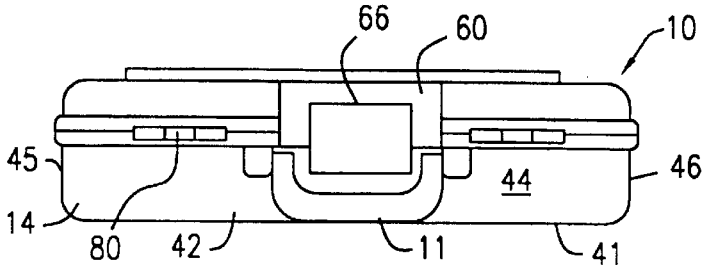
FIG. 3 is a front view of the preferred embodiment of the invention shown in FIG. 2.
Figure 4:
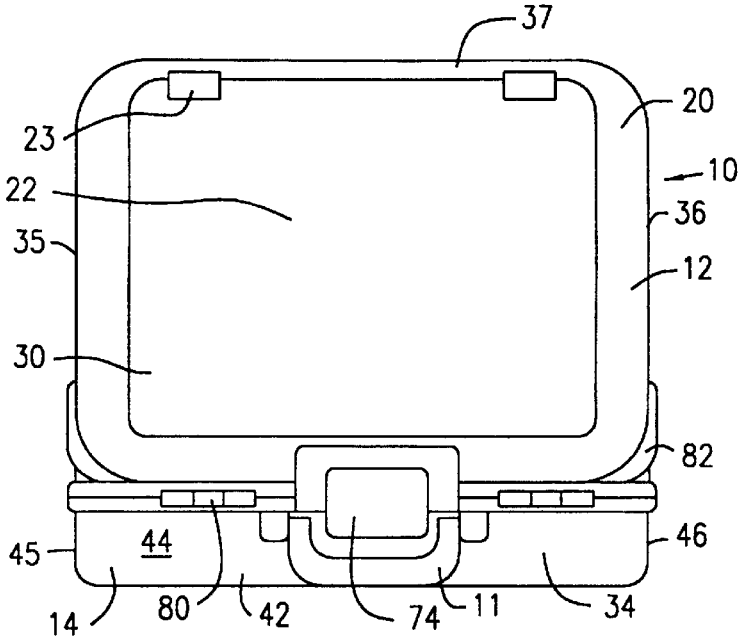
FIG. 4 is a front view of the preferred embodiment of this invention shown in FIG. 3 with the easel surface supported in its open, accessible position.
Figure 5A:
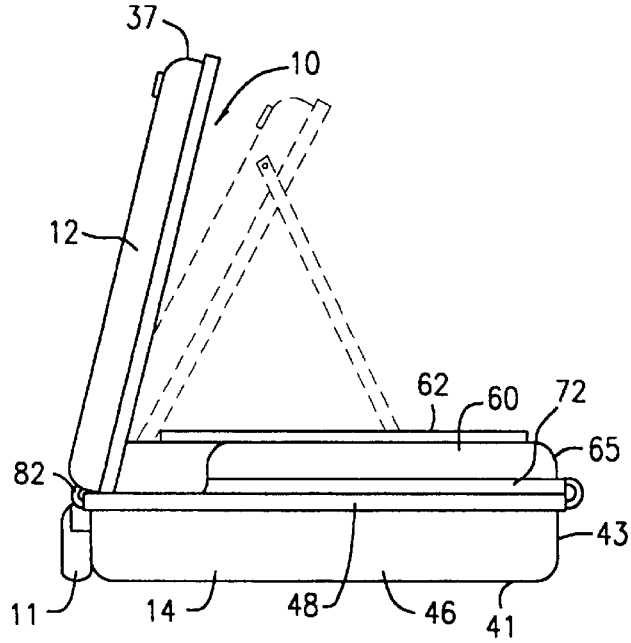
FIG. 5A is a side view of the preferred embodiment of this invention, as shown in FIG. 4 with the easel surface supported in its open, accessible position, the A-shaped bracket support not being shown in solid line for ease of illustration (dotted lines show the easel and the hinged A-shaped bracket support in an alternate inclined position); this view shows the horizontal, second artwork support surface behind the inclined easel.
Figure 6:
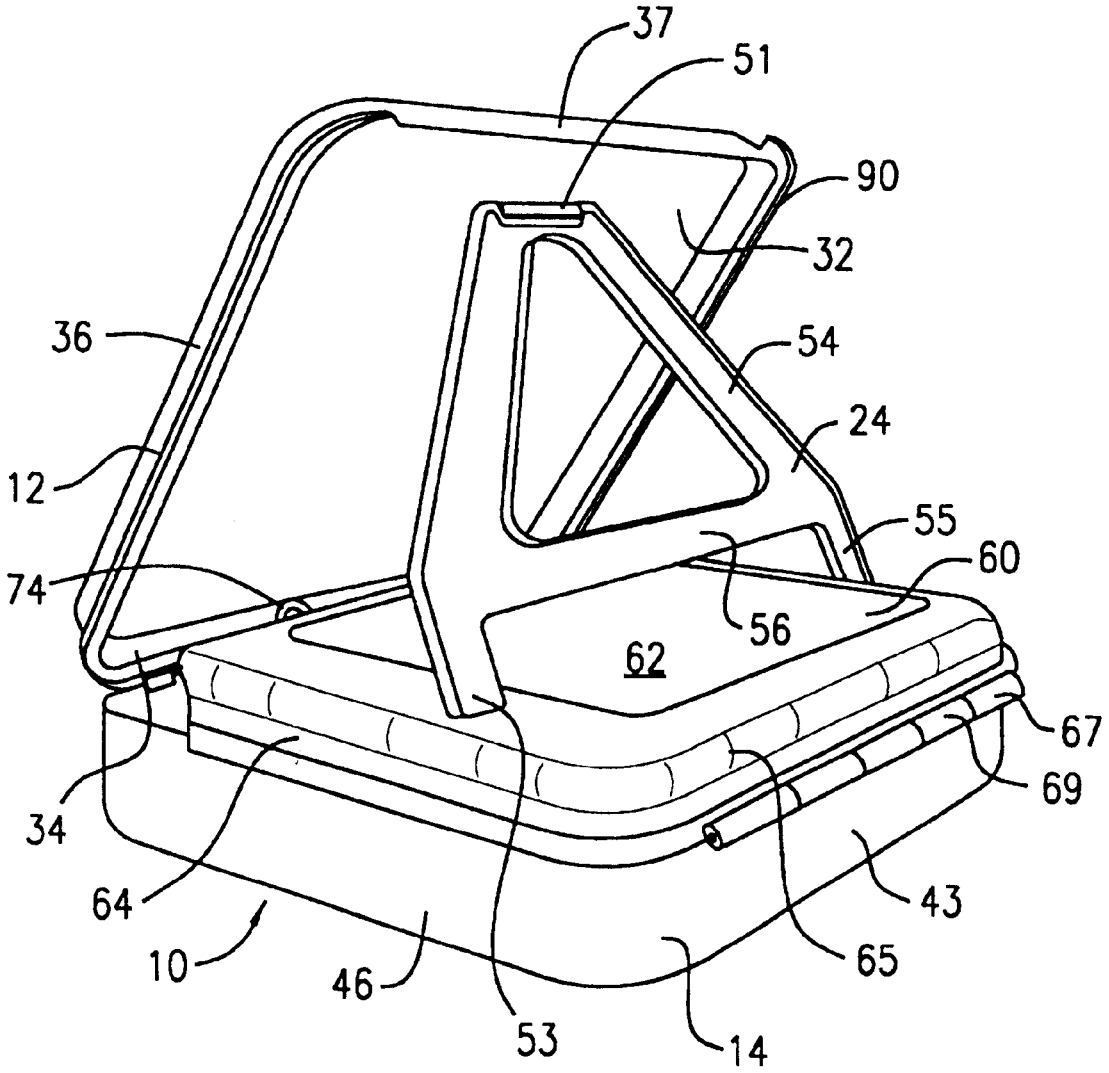
FIG. 6 is a right, side, rear perspective view of the preferred embodiment of this invention, showing the A-shaped bracket support holding the easel surface at an inclined angle with respect to the horizontal, second artwork support surface.
Figure 7:
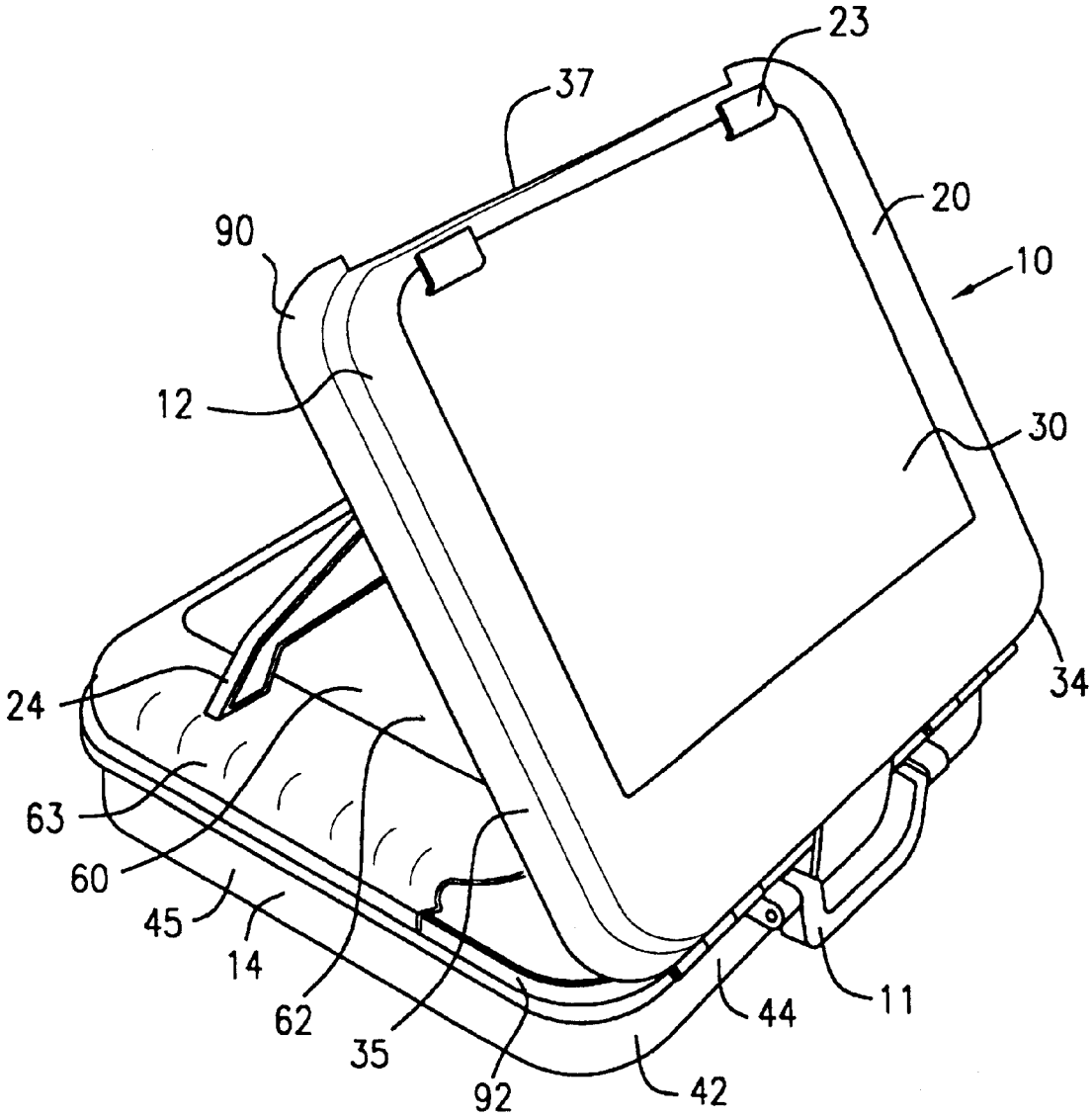
FIG. 7 is a front, top, left perspective view of the preferred embodiment of the device shown in FIG. 6, again showing the inclined artwork supporting surface (an easel surface) in the open position and the horizontal, second artwork support surface behind it.

Similarly, the horizontal, second artwork supporting surface 60 and the lower housing 14 are hinged together so that the horizontal, second artwork supporting surface 60 may rotate about the lower housing 14 to cover it when the upper housing is erected to provide an easel-like, artwork supporting surface (see FIG. 5A, 6 and 7). Furthermore, when the upper housing is moved away from the lower housing, the hinge between the lower housing 14 and the horizontal, second artwork supporting surface 60 enables the child to have access to the inside compartment of the lower housing where art supplies may be located. The hinge also allows the horizontal, second artwork supporting surface 60 to be placed on the upper housing 12 when the upper housing 12 is first closed over the lower housing 14 (as shown in FIGS. 1–3) so that a child can draw, sketch, use chalk, etc. on the horizontal, second artwork supporting surface 60.

The upper housing 12 is formed of a flat, top surface 30 with four downwardly extending side walls 34, 35, 36 and 37. Side walls 35 and 36 are on the sides of the product while front side wall 34 is hinged to the lower housing 14 and rear side wall 37 is free, i.e., not connected to the lower housing. The side walls 34, 35, 36, and 37 and the flat top surface 30 of the upper housing create a cavity, opening towards the bottom of the upper housing 12 and facing the opening of the lower housing.

The lower housing 14 has a flat bottom 41 with four upwardly extending side walls 43, 44, 45 and 46 so that it is open towards its top. It forms an open cavity extending upwardly and facing the open-bottom of the upper housing.

The cavity of the lower housing is a container for art supplies. The lower housing 14 is provided with a hinged handle 11, sized to conform, preferably, to a small child's hand. As mentioned, the handle 11 projects from the front and outside edge 42 of lower housing 14. The handle 11 is hinged to the lower housing by conventional means. When the handle is pulled away from the lower housing to allow a child's hand to grip therethrough, the child can easily carry the portable art supply carrying case and multiple artwork supporting surfaces.

The opposed side walls 45 and 46 are on the sides of the lower housing 14 and correspond to the side walls 35 and 36 of the upper housing 12. The rear side wall 43 of the lower housing 14 is hinged to the horizontal, second artwork supporting surface 60 while the front side wall 44 is hinged to the front wall 34 of the upper housing 12 (see FIGS. 4 and 7).

The upper housing 12 comprises a frame 20 having a centrally located paper supporting surface 22. The paper supporting surface 22 is provided with two opposed, hinged clips 23 which frictionally hold a sheet of paper onto the paper supporting surface 22. The clips 23 are conventional and are found in other portable easels. They allow one or more sheets of paper to be placed on the paper supporting surface 22 and allow the child to selectively remove one or more papers. The clips 23 are resilient and provide frictional engagement for the paper. The supporting surface 22, in the preferred embodiment, comprises a magnetic, whiteboard surface to provide two additional modalities of art for the child, namely, a whiteboard surface for using whiteboard markers (an eraser can be stored in the lower housing 14 for selectively erasing the artwork) and a magnetic surface for magnetic letters/numbers and characters (the magnetic pieces can also be stored in the lower housing 14, when not in use).

The upper housing 12 is hingedly secured to the lower housing 14 by a hinge mechanism 80. The hinge mechanism 80, extending between the upper housing 12 and the lower housing 14 comprises projections or ears 82 of the upper housing 12 (integrally molded therewith) interlacing with corresponding and spaced hinge projections or ears 84 of the lower housing 14 (also molded therewith). In one embodiment the ears have a central bore for accepting and securing a metal pin (not shown). Alternatively, the hinge projections or ears of either the upper or lower housing are provided with a plastic rod-like projection passing into the bore of the adjacent projection or ear of the other member, again in a quite conventional manner of hinging toy plastic components together.

The outside rim 90 (see FIGS. 6 and 7) of the upper housing 12 is dimensioned to overlie in size and correspond in curvature to the rim 92 (see FIG. 7) of the lower housing 14 such that when the upper housing 12 is rotated upon the lower housing 14, the two pieces cooperate to frictionally close the container portion of the device. The upper housing is sufficiently deep, i.e., the side walls project downwardly from the flat, top surface 30 so that the A-shaped support bracket 24 is fully housed therein, when the device is closed.

Figure 5B:
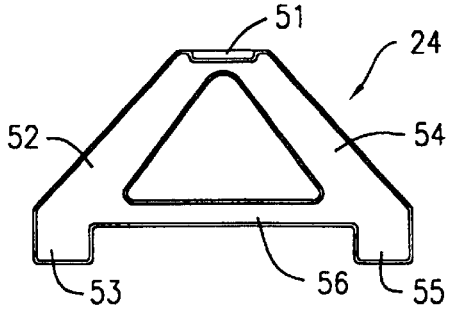
FIG. 5B is a top plan view of the A-shaped bracket support or frame used to secure the easel surface in its inclined position.

As shown in FIGS. 5A and 5B, the upper housing 12 is provided with an A-shaped support bracket 24. This bracket comprises an apex 51, two diverting legs 52 and 54 (see FIG. 5B) and a cross-piece 56 connecting the two legs 52 and 54. The top or apex 51 of the A-shaped bracket 24 is hinged to the rear 32 of the flat top surface 30 of the upper housing 12 so that the A-shaped bracket 24 can be nested into the upper housing or can be swung away from the upper housing 12. In a preferred embodiment the rear or bottom 32 of the flat top surface 30 is provided with a clip to hold and secure the cross piece 56 within the cavity of the upper housing 12. Two downwardly projecting support legs 53 and 55 extend from the legs 52 and 54, respectively and provide support for the A-shaped support bracket 24 on the surface of the horizontal, second artwork supporting surface 60. The A-shaped support bracket 24 is sufficiently thin such that it nests beneath and within the confines of the downward opening or cavity formed by the upper housing 12.

The horizontal, second artwork supporting surface 60 has a flat upper surface 62 and downwardly extending side walls 63 and 64. The rear wall 65 also projects downwardly from the flat upper surface 62 and has corresponding projections or ears 67 which allow the horizontal, second artwork supporting surface 60 to hingedly secure to and rotate about the lower housing 14. The ears 67 mate with spaced projections or ears 69 of the lower housing 14 to provide a conventional hinge for two plastic parts. Again, either a metal pin will connect the bores of the ears of the lower housing with the bores of the ears 67 of the horizontal, second artwork supporting surface 60 or a plastic, molded pin of one of the components will extend into the bore of the other component, in a conventional manner to provide a hinge mechanism.

The flat upper surface 62 can be provided with paper engaging clips (not shown) for securing art paper to the horizontal, second artwork supporting surface 60, similar to those clips 23 provided on the upper housing. The flat upper surface 62 can be provided with a blackboard-like surface, a magic writing surface (like that made by RoseArt Industries Inc. of Livingston, N.J. and sold under the tradename and model name: MAGICCOLOR Drawing Board, Item #3237) or any other writing and/or art surface.

In the preferred embodiment, the horizontal, second artwork supporting surface 60 has an outer rim 72 which mates, dimensionally (rim 72 is slightly larger than outside rim 48) and in curvature, to the outside rim 48 of the lower housing 14 such that the horizontal, second artwork supporting surface 60 is supported on the lower housing (see FIGS. 5A, 6 and 7). The top surface 62 of the horizontal, second artwork supporting surface 60 is provided with at least two sets of opposed, i.e., on opposite sides of the writing surface, yet spaced, recesses or upwardly protruding bumps, spaced from front to rear, for receipt or support of the support legs 53 and 55 of the A-shaped support bracket 24. This allows the upper housing 12 with its inclined easel and artwork surface to be maintained in two or more angular orientations. The bumps, in the alternate embodiment, provide a positive ledge against which the support legs 53 and 55 rest.

The front corners of the horizontal, second artwork supporting surface 60 are mitered, i.e., the side walls 63 and 64 do not extend the full dimension front to rear of the flat surface and the front wall of the horizontal, second artwork supporting surface 60 does not extend side-to-side across the entire front wall of the lower housing 14. However, the center section of the front wall 66 of the horizontal, second artwork supporting surface 60 is provided with a curved closing handle 74 (see FIGS. 1 and 3) which projects forwardly and over the center of the upper rim of the lower housing 14 to frictionally engage the same. It is biased by a spring against the lower housing. This handle, when engaged by the child, can be rotated or moved away from the rim of the lower housing (against the bias) and allows for rotation of the horizontal, second artwork supporting surface 60. Rotation of the horizontal, second artwork supporting surface 60 with respect to and away from the lower housing 14 allows for erecting the easel or upper housing 12 and provides, after the upper housing is rotated out of the way, access to the contents and space of the lower housing 14. Rotation of the horizontal, second artwork supporting surface 60 towards the lower housing secures the horizontal, second artwork supporting surface 60 in place, rim 72 on rim 48, substantially closing off the lower housing and its contents (see FIG. 5A, 6 and 7). It should be appreciated that the horizontal, second artwork supporting surface 60 can also be rotated about the hinge to cover the device, with the upper housing directly on top of the lower housing (rim of upper housing within rim 48 of lower housing, and with the closing handle 74), frictionally secured to the lower housing. The closing handle 74 secures the horizontal, second artwork supporting surface 60 onto the lower housing 14 with the upper housing 12 sandwiched therebetween (see FIGS. 1, 2 and 3).

In use, the device can hold, within the container defined between the lower housing 14 and the horizontal, second artwork supporting surface 60 or the upper housing 12, art supplies, e.g., crayons, chalk, pencils, paintbrushes, paints, eraser, magnetic pieces, etc. The device can be used by a child with the container closed, i.e., without access to the lower housing. The child can write or create artwork upon paper secured to the horizontal, second artwork supporting surface 60 (See FIGS. 1, 2 and 3) or may create artwork directly on the blackboard, magic board, etc., of the horizontal, second artwork supporting surface 60. Then, if desired, the child can, by using handle 74, rotate the horizontal, second artwork supporting surface 60 about the hinges connecting it to the lower housing 14 to gain access to the upper housing 12. With upper housing 12 rotated about its hinges on the lower housing such that it is substantially perpendicular to the lower housing, access is obtained to the contents of the lower housing. Then, the child can rotate the horizontal, second artwork supporting surface 60 such that it rests upon the lower housing and the A-shaped bracket 50 with its support legs 53 and 55 can be manipulated such that the legs are held in place in the desired recesses (on in front of the bumps) of the horizontal, second artwork supporting surface 60. This provides an inclined easel-like surface for the child. The child can place paper on the upper housing, beneath the clips 23, or can use whiteboard markers on the whiteboard. Alternatively, the child can use magnetic pieces on the magnetic, white board.

When finished, the device can be folded with upper housing on lower housing and horizontal second, artwork supporting surface on top of the upper housing. The child can transport the device by using the handle 11. The device is securely closed when the upper housing is on the lower housing, with the rim of the upper housing superimposed and captured by the rim of the lower housing, with the horizontal, second artwork supporting surface 60 over the upper and lower housing, in a frictional fit with its rim engaging the rims of the upper and lower housing. The closing handle 74 ensures the closure of the device.

Having described this invention with regard to specific embodiments, it is to be understood that the description is not meant as a limitation since further modifications and variations may be apparent or may suggest themselves to those skilled in the art. It is intended that the present application cover all such modifications and variations as fall within the scope of the appended claims.

I claim:

1. An integrated easel, horizontal artwork support surface and art supply carrying case comprising:

an upper housing providing a downwardly extending cavity;

a lower housing having an upwardly extending cavity, said upper housing being hingedly connected to said lower housing about their respective front walls;

a horizontal, second artwork- supporting surface hingedly connected to said lower housing about their respective rear walls;

said upper housing having a flat surface for artwork and an easel-like stand hingedly attached to the rear of said flat surface which cooperates with said horizontal, second artwork supporting surface for holding said flat surface at an angle with respect to said lower housing, wherein said lower housing and said horizontal, second artwork supporting surface mate about their outer rims, with said upper housing therebetween, for transporting said carrying case.

2. An integrated easel, horizontal artwork support surface and art supply carrying case as claimed in claim 1, wherein said flat surface for artwork of said upper housing is a whiteboard.

3. An integrated easel, horizontal artwork support surface and art supply carrying case as claimed in claim 1, wherein said flat surface for artwork of said upper housing is a magnetic whiteboard.

4. An integrated easel, horizontal artwork support surface and art supply carrying case as claimed in claim 1 wherein said horizontal, second artwork supporting surface is an art media surface selected from the group: a blackboard, a whiteboard, a magnetic whiteboard, a magic slate and a paperholding board.

5. An integrated easel, horizontal artwork support surface and art supply carrying case as claimed in claim 1 wherein said flat surface for artwork of said upper housing is provided with paper holding clips.

6. An integrated easel, horizontal artwork support surface and art supply carrying case as claimed in claim 1 wherein said easel-like stand is confined within said cavity of said upper housing.

7. An integrated easel, horizontal artwork support surface and art supply carrying case as claimed in claim 1 wherein said horizontal, second artwork supporting surface is provided with a closing handle which frictionally engages said lower housing to maintain said carrying case in a closed position.

8. An integrated easel, horizontal artwork support surface and art supply carrying case as claimed in claim 1 further comprising art supplies carried within said cavity of said lower housing.

9. An integrated easel, horizontal artwork support surface and art supply carrying case as claimed in claim 1 wherein said horizontal, second artwork supporting stand is provided with spaced recesses for accepting the legs of said easel-like support.

10. An integrated easel, horizontal artwork support surface and art supply carrying case as claimed in claim 9 wherein at least two sets of said spaced recesses are provided to said horizontal, second artwork supporting surface for changing the angle of support of said easel-like stand.

11. A carrying case for an angled artwork support and art supplies comprising a lower housing forming a cavity for holding art supplies, an upper housing having an attached support for holding said upper housing and artwork placed thereon at an angle with respect to said lower housing, said upper and lower housing when superimposed one on the other providing a sealed carrying case for art supplies, and a horizontal planar member attached to said lower housing and superimposable over said upper housing also for supporting artwork placed thereon.

12. A carrying case as claimed in claim 11 Wherein said upper housing is an art surface selected from the group consisting of: a whiteboard; a blackboard; a magnetic whiteboard; a paper holding board and a magic slate.

13. A carrying case as claimed in claim 11 wherein said horizontal plane is an art surface selected from the group consisting of: a whiteboard; a blackboard; a magnetic whiteboard; a paper holding board and a magic slate.

14. A carrying case as claimed in claim 11 further comprising art supplies.

15. A carrying case as claimed in claim 11 wherein said horizontal planar member attached to said lower housing is provided with a closing handle for selectively frictionally securing said horizontal planar member to said lower housing.

16. A carrying case as claimed in claim 11 wherein said upper housing and said horizontal planar member are provided with outside rims which selectively mate with the outside rim of said lower housing.

17. A carrying case as claimed in claim 11 wherein said upper housing is hingedly secured to said lower housing on a side thereof opposite to said horizontal planar member's hinged securement to said lower housing.

18. A carrying case as claimed in claim 11 wherein substantially all components are made of lightweight plastic.

19. A carrying case as claimed in claim 11 wherein said horizontal planar member provides at least two spaced support members for holding said support in at least two angular positions with respect to said lower housing.

* * * * *